US006729377B2

(12) United States Patent
Huthmacher

(10) Patent No.: US 6,729,377 B2
(45) Date of Patent: May 4, 2004

(54) HAND-HELD DEVICE FOR TRANSFERRING A FILM AND HAVING AN ANGULAR APPLICATION MEMBER

(75) Inventor: Winfried Huthmacher, Frankfurt (DE)

(73) Assignee: Societe BIC (FR)

( * ) Notice: Subject to any disclaimer, the term of this patent is extended or adjusted under 35 U.S.C. 154(b) by 0 days.

(21) Appl. No.: 10/225,441

(22) Filed: Aug. 22, 2002

(65) Prior Publication Data

US 2003/0034133 A1 Feb. 20, 2003

Related U.S. Application Data

(63) Continuation of application No. PCT/EP01/01628, filed on Feb. 14, 2001.

(30) Foreign Application Priority Data

Feb. 25, 2000 (EP) ..... 00103985

(51) Int. Cl.[7] ..... B32B 31/00

(52) U.S. Cl. ..... 156/577; 156/523; 156/579; 118/76; 118/257; 242/160.4; 242/171; 242/588.6; 206/411

(58) Field of Search ..... 156/523, 577, 156/579, 574, 527, 23.8, 540; 242/588.2, 588.6, 160.2, 160.4, 588, 588.3, 170, 171; 225/46; 118/76, 200, 257

(56) References Cited

U.S. PATENT DOCUMENTS

| | | | | |
|---|---|---|---|---|
| 3,954,258 A | * | 5/1976 | Skipor et al. | 493/445 |
| 4,425,771 A | * | 1/1984 | Beach et al. | 70/276 |
| 5,303,759 A | | 4/1994 | Czech | 156/574 |
| 5,393,368 A | | 2/1995 | Stevens | 156/577 |
| 5,772,840 A | * | 6/1998 | Morinaga | 156/540 |
| 5,795,085 A | | 8/1998 | Yoo | 400/248 |
| 6,273,169 B1 | | 8/2001 | Ono et al. | 156/540 |

FOREIGN PATENT DOCUMENTS

| | | |
|---|---|---|
| EP | 0 936 171 | 8/1999 |
| JP | 10-181289 | 7/1998 |
| JP | 11-170776 | 6/1999 |
| WO | WO 91/09805 | 7/1991 |

* cited by examiner

*Primary Examiner*—Richard Crispino
*Assistant Examiner*—Cheryl N. Hawkins

(57) ABSTRACT

The invention relates to a hand-held device for transferring a film of adhesive, covering or colored material onto a substrate. The invention has a housing in which a film supply is arranged and an application member which extends from the interior of the housing to the outside through an opening in the housing and consists of a bearing section pivotably mounted about a swivelling axis in the housing and an application end, the film extending from the supply to the application member. To achieve a smaller construction, the application end extends from the bearing section, wherein the application end and the bearing section enclose an obtuse angle therebetween which is open towards the film approach side of the application member.

25 Claims, 6 Drawing Sheets

HAND-HELD DEVICE FOR TRANSFERRING A FILM AND HAVING AN ANGULAR APPLICATION MEMBER

CROSS REFERENCE TO RELATED APPLICATIONS

The present application is a continuation of U.S. National Stage designation of co-pending International Patent Application PCT/EP01/01628, filed on Feb. 14, 2001, which claims priority to European Patent Application 00 103 985.8, filed Feb. 25, 2000. The entire content of both these applications is expressly incorporated herein by reference thereto.

FIELD OF THE INVENTION

The invention relates to a hand-held device for the transfer of film from a tape applicator onto a substrate.

BACKGROUND OF THE INVENTION

A hand-held device of this type (alternately referenced herein as a tape applicator for the sake of convenience without any intent to limit) is described in EP 0 507 818 B1 (corresponding U.S. Pat. No. 5,303,759 to Czech). This known hand-held device comprises a housing and an application member which extends from the interior of the housing to the outside through an opening in the housing. The application member has a swivelling axis in the form of a curved bulge which is connected to a plate-shaped application body by a lateral longitudinal web. A spatula, in the form of an extension, extends from the outward-pointing front end of the application body or apparatus. The spatula forms an application end or edge of the application member for a backing tape which extends outwards from a supply reel rotatably mounted in the housing to the ridge of the spatula where it is deflected and then stretches back inwards to a take-up reel rotatably mounted in the housing. In this known design, the spatula is arranged as a front-end extension of the application body such that it is laterally offset from a swivelling axis, namely towards the side with which the hand-held device is to be placed on or applied to a substrate in the operating mode. The swivelling axis is arranged laterally offset on the longitudinal web and is mounted in a correspondingly curved undercut bearing groove of a bearing part in the housing, wherein the gap between the side edges of the bearing groove is greater than the thickness of the longitudinal web. As a result, the thus formed bearing for the application member has a degree of freedom in the peripheral direction which allows a limited lateral to and fro swivelling of the application member relative to the housing and thus adaptation to a laterally inclined substrate surface. This makes it easier to handle the device, wherein the spatula can also adapt to the substrate surface if the substrate is laterally inclined or if the device is applied at a slant.

As a result of the laterally offset arrangement of the spatula in relation to the swivelling axis, however, this known arrangement has a relatively large and bulky construction caused by the offset. This is undesirable in a device of this type because a large construction, especially in the region of the housing opening, particularly obstructs the user's view of the application member when the application is to be positioned accurately, for example, when applying the coating onto just a certain surface section of the substrate. In addition, the known device has a complicated construction causing complex and costly manufacture and assembly which leads to high production costs. As the device in question is a typical mass-production product, simple design and assembly is desirable in order to reduce production costs.

In the hand-held device known from EP 0 507 818 B1 (corresponding U.S. Pat. No. 5,303,759 to Czech), the application member is mounted so as to be freely pivotable in the restricted swivelling region. As a result of gravity, the application member will therefore always adopt a position in which its application member body supporting the spatula points downwards. This impairs handling because the spatula can be slanted in relation to the hand-held device as a whole. This leads to the spatula being applied to the substrate at a lateral inclination, particularly when the film is applied onto an inclined substrate. Only once the application member is pressed onto the substrate is the application member pushed into its position parallel to the substrate. A further disadvantage of the design according to this patent is that, when the application member bears on its swivel stops, a lateral tilting of the spatula during moving of the device when applying the film can hardly be avoided and this impairs the film application.

SUMMARY OF THE INVENTION

The present invention is a device for applying a film to a substrate designed such that the housing can be formed with a small structure in the application member region. A structure which can be manufactured and assembled simply and inexpensively is desired in order to reduce the production costs of the device.

The application end of the application member of a device formed in accordance with the principles of the present invention is formed by an extension of the bearing section, the application end and the bearing section enclosing an obtuse angle therebetween. This makes it possible to achieve a simple and material-saving construction, wherein an additional application body portion laterally offset from the bearing section as present in the generic device can be omitted. Thus, space is created in which the housing can be formed smaller in the region of the opening, leading to a better view which allows accurate working with the hand-held device, for example, for applying the film onto certain areas which can also be relatively small as they are easier to see as a result of the improved view. In doing so, the ergonomic advantage resulting from the application end and its ridge being offset from the swivelling axis of the bearing section is maintained. In an embodiment formed according to the principles of the present invention, this is achieved by the bend or curve. A further advantage of the embodiment according to the principles of the present invention consists in the fact that, owing to the lower material usage, it is also lighter in weight and is therefore advantageous not only from an ergonomic point of view but also for weight-saving reasons.

The embodiment according to the principles of the present invention is particularly suitable for an application member having an application end in the form of a spatula which, as a result of its flat or wedge-shaped advance to a thin ridge, allows its position on the substrate to be accurately visually determined and the film to be accurately applied to the substrate.

In this type of device having an application member, the free application end of which is formed by a spatula, a lateral guide for the film is needed in the spatula region to guarantee that the film does not slip away sideways during its sliding circulation at the ridge of the spatula. In this respect, it is known to arrange side guiding webs or guide wings (alternately referenced herein as guiding webs without any intent to limit) on both broad sides of the spatula between which the film slides during operation.

The invention is based on the knowledge that sufficient guidance is also guaranteed if just one guiding web is arranged on each broad side of the spatula, both of which webs are however arranged on both sides of the film so that the guiding web on one broad side forms a lateral guide and the other guiding web on the other broad side forms a guide on the other side of the film. This not only saves on material, but this design also contributes towards improving the view of the application point so that the film can also be applied accurately to the substrate in this aspect of the invention. The spatula with its guiding webs can be formed with a Z-shaped cross-section. In this case, the guiding webs are located in a common transverse plane.

The construction of the device formed in accordance with the principles of the present invention is simple and inexpensive to produce and improves pivoting guidance and axial positioning.

The present invention also provides a device that facilitates application of a film to a substrate.

To achieve this object, the swivel movement stops for the application member are formed in a resiliently flexible manner. As a result, the application member can still adapt to positioning differences between the device and the substrate, also within the region of its lateral restriction, and so a full or linear application is still guaranteed. To achieve this, the swivel movement stops can be formed by spring elements which guarantee the elasticity in the side pivot end region. It is particularly advantageous when the application member is mid-centered in a central swivel position by elastic forces. In such an embodiment, the application member is always located in a position defined with regard to the device although the lateral freedom of motion is guaranteed and the application member can adapt laterally in this region.

Another particularly simple design is produced when one single spring guarantees the mid-centering, wherein the spring can be arranged on the application member with its free end section positioned on the housing or can be arranged on the housing with its free end positioned on the application member. Within the scope of the invention, this spring can be a spiral spring or a torsion spring.

BRIEF DESCRIPTION OF THE DRAWINGS

The detailed description will be better understood in conjunction with the accompanying drawings, wherein like reference characters represent like elements, as follows.

DETAILED DESCRIPTION OF THE INVENTION

Figure 1:
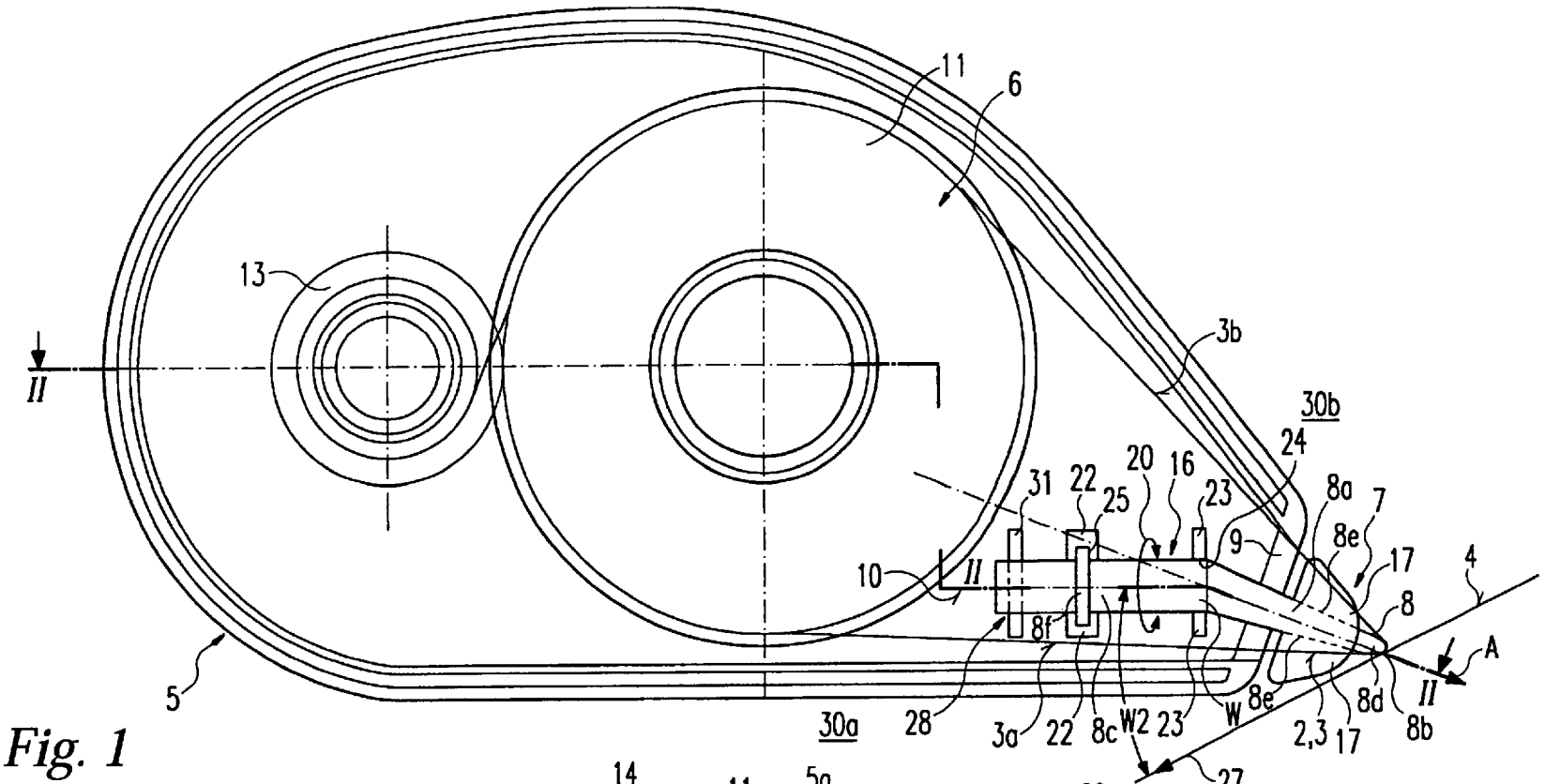
FIG. 1 is side elevational view along line I—I of FIG. 2 of a hand-held device formed in accordance with the principles of the present invention.

Embodiments of the invention are described below by referring to the drawings. Exemplary tape applicators and application members thereof formed in accordance with the principles of the present invention are illustrated in FIG. 1 through FIG. 13, in which same reference numbers refer to similar constituent components or elements.

The hand-held device of the present invention, generally denoted as 1, as shown in FIG. 1, serves to transfer a film 2 from a backing tape 3 onto a substrate 4. A supply 6 for backing tape 3 and/or film 2 is arranged in a housing 5. An application apparatus 7 having an application member 8 extends through housing 5 from the interior to the outside in the region of an opening 9. An application end 8*a* sticks out from housing 5 to which backing tape 3 and/or film 2 extends.

Supply 6 can be formed by a supply reel 11 on which backing tape 3 and/or film 2 is wound, wherein, if a backing tape 3 is present, film 2 is located in the outer side of tape section 3*a* extending from supply reel 11 to application member 8. If there is a backing tape 3, a take-up reel 13, to which a tape portion 3*b*, extends is also rotatably mounted in housing 5. The tape portion runs as a continuing tape portion 3*b* around a ridge 8*b* of application end 8*a* and extends to take-up reel 13.

Housing 5 is hand-sized and is a flat housing arranged upright in its use position and tapers towards application member 8 and/or towards opening 9 in a preferably wedge-shaped manner.

Figure 2:
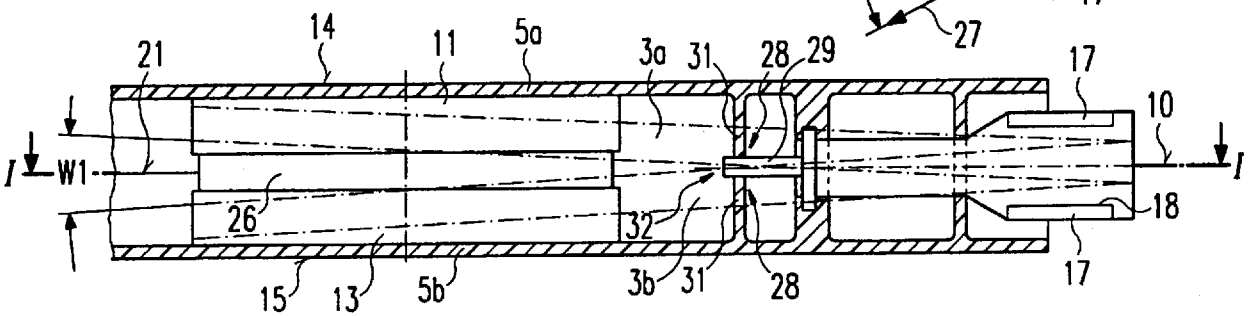
FIG. 2 is a bottom cross-sectional view of the front end portion of the device according to FIG. 1 cut along Line II—II.
Figure 3:
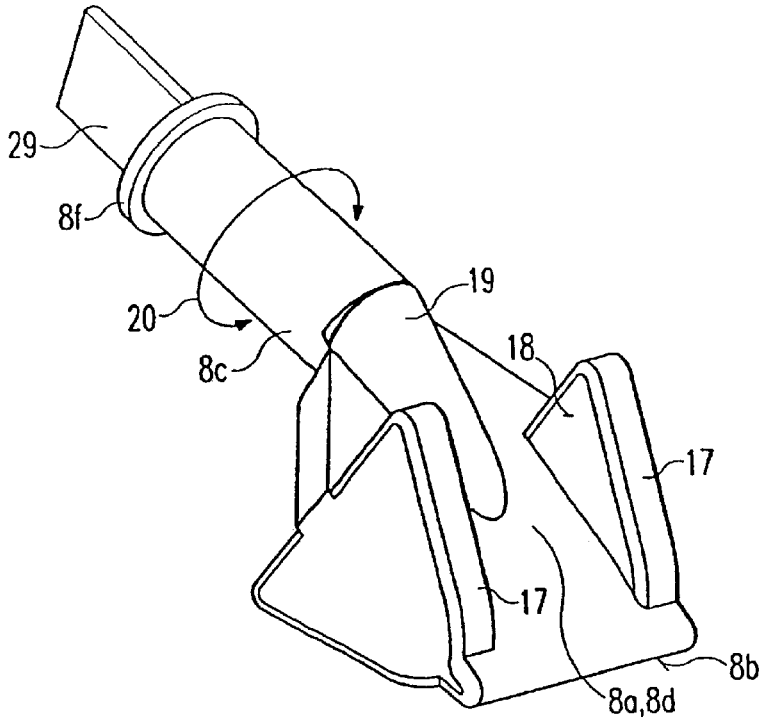
FIG. 3 is an application member of the device according to FIG. 1 viewed from the front and diagonally downwards.

Application member 8 consists of a bearing section 8*c* with which it is pivotably mounted in a swivel bearing 16 in the tapered end portion of housing 5 and a spatula 8*d* forming application end 8*a* which, in the exemplified embodiment depicted in FIGS. 1 to 3, is formed by an extension of bearing section 8*c*, and therefore continues from the front end of bearing section 8*c* facing opening 9, passes through opening 9 and sticks out from the tapered end of housing 5 with its ridge 8*b* which extends transversely to broad sides 14, 15 of housing 5. Spatula 8*d* has the shape of a wedge, point or ridge 8*b* of which is curved. In the middle or front end portion of spatula 8*d*, lateral guiding webs 17 are arranged protruding from both wedge surfaces 8*e*. Each guiding web 17 borders a guide groove 18 which is at least as wide as or wider than film 2 and backing tape 3 so that these parts are guided therein.

As can be seen from FIG. 3, application end 8*a* has broader dimensions than bearing section 8*c*, wherein its inner end tapers towards bearing section 8*c*. Application end 8*a* can also be thinner than the affiliated measurement of bearing section 8*c*, wherein a bulge 19 is provided on at least one side in the transition section to stabilize application end 8*a* on bearing section 8*c*.

As may be appreciated with reference to FIG. 1, application end 8*a* stretches towards the application side or film/tape approach side in a curved or angled manner, application end 8*a* and bearing section 8*c* enclosing an obtuse angle W of approximately 120° to 170°, in particular about 150°. In doing so, application end 8*a* can extend in an application direction A which runs at approximately right angles to the plane of opening 9, bearing section 8*c* enclosing an acute angle with the application direction A.

As shown in FIG. 2, housing 5 consists of two housing parts 5*a*, 5*b*, which can be joined together at a division seam 21 running in the center or on one side and parallel to broad sides 14, 15. Housing parts 5*a*, 5*b* and are connected to each other by a (not illustrated) closing.

As shown in FIG. 1, swivelling bearing or drag bearing 16 (referenced herein as a swivelling bearing for the sake of convenience and without any intent to limit) is formed by four bearing webs 22, 23 which project inwards from the broadsided side walls of housing 5 and have shell-shaped bearing recesses 24, 25 on their free ends which are adapted to bearing section 8*c* so that the latter is freely rotatably or pivotably mounted therein.

Swivelling bearing 16 bears application member 8 both radially and axially (See FIG. 1). As to the axial bearing, a radially distanced bearing shoulder 8*f*, in this case a bearing ring, can be provided on bearing section 8*c*, in particular on inner bearing web 22, which engages in a bearing recess 25 in inner bearing web 22.

Within the scope of the present invention, supply reel 11 and take-up reel 13 can be arranged behind one another according to FIG. 1 so that backing tape 3 and/or film 2 circulates in one plane. Alternately, supply reel 11 and take-up reel 13 can be arranged next to each other as in FIG. 2 so that (as described above) the tape sections 3*a*, 3*b* enclose an acute angle W1 between them which is open towards reels 11, 13. Between reels 11, 13, there is provided a drive connection 26 (see FIG. 2). In each case, drive connection 26, which is effective between reels 11, 13, drives the take-up reel 13 independently of whether the effective winding diameters are large or small with such an effective circumferential speed that the circumferential speed of take-up reel 13 is larger than that of supply reel 11. An integrated drive slipping guarantees that although take-up reel 13 always attempts to keep backing tape 3 and/or film 2 taut, this tautness is limited by the slipping. This prevents the formation of a loop yet limits the tensile stress so that film 2 and backing tape 3 do not rip. Drive connection 26 can be formed by a known sliding coupling, for example, by a geared sliding coupling.

In the operating mode for applying film 2 onto substrate 4 (see FIG. 1), device 1 is placed manually at an angle W2 of approximately 45° between bearing section 8*c* and substrate 4 and with ridge 8*b* on substrate 4 and moves backwards in the direction of arrow 27. In doing so, tape section 3*a* is automatically pulled off and wound back up after detachment of film 2 on substrate 4.

Application member 8 has a limited degree of swivelling freedom on both sides (see double-headed arrow 20 in FIGS. 1 and 3) which allows application member 8 to pivot about swivelling axis 10 and to adapt to the position of substrate 4 when device 1 is applied at an angle or when device 1 is placed on a laterally slanted substrate 4, this being effected automatically by the pressing against substrate 4. Each of the sideways swivelling movements is restricted by a stop 28 each of which is preferably resiliently flexible so that, when working with device 1 in a lateral stop position of application member 8, the device can still yield elastically and can thus adjust without standing on a side corner of ridge 8*b* which would impair the application of film 2. Stops 28 can, for example, be formed by pliable spring elements.

According to the principles of the present invention, one single spring element 29 may be is fixed on housing 5 and acts upon application member 8 between two stops 28 which are effective in the swivelling direction (not illustrated). In another embodiment (as illustrated in FIG. 2), one spring element 29 is fixed on application member 8 and is arranged between two stops 28 arranged on the application member 8 which are effective in the peripheral direction. In the embodiment exemplified in FIG. 3, spring element 29 is a leaf spring which projects, for example, coaxially from bearing section 8*c*, here inwards, and is bordered by two stop webs 31 which protrude inwards from housing parts 5*a*, 5*b*, in particular their side walls (FIG. 2). When torque is exerted on application member 8 when pressing ridge 8*b* onto substrate 4, leaf spring 29 performs a torsion movement so that application member 8 can follow the lateral swivelling movement, wherein leaf spring 29 is tensed and moved back into the centered starting position following elimination of the torque. The same function automatically takes place in the case of torque effective in the other swivelling direction. As a result, an elastically effective mid-centering apparatus 32 is realized which resiliently mid-centers application member 8 in its central position. Consequently, application member 8 can automatically adjust under the exerted pressure against the restoring elasticity when there is a lateral inclined position between ridge 8*b* and substrate 4, thus making handling simpler, improving film application, and reducing the risk of the device lying laterally on one corner of ridge 8*b*.

Figure 4:
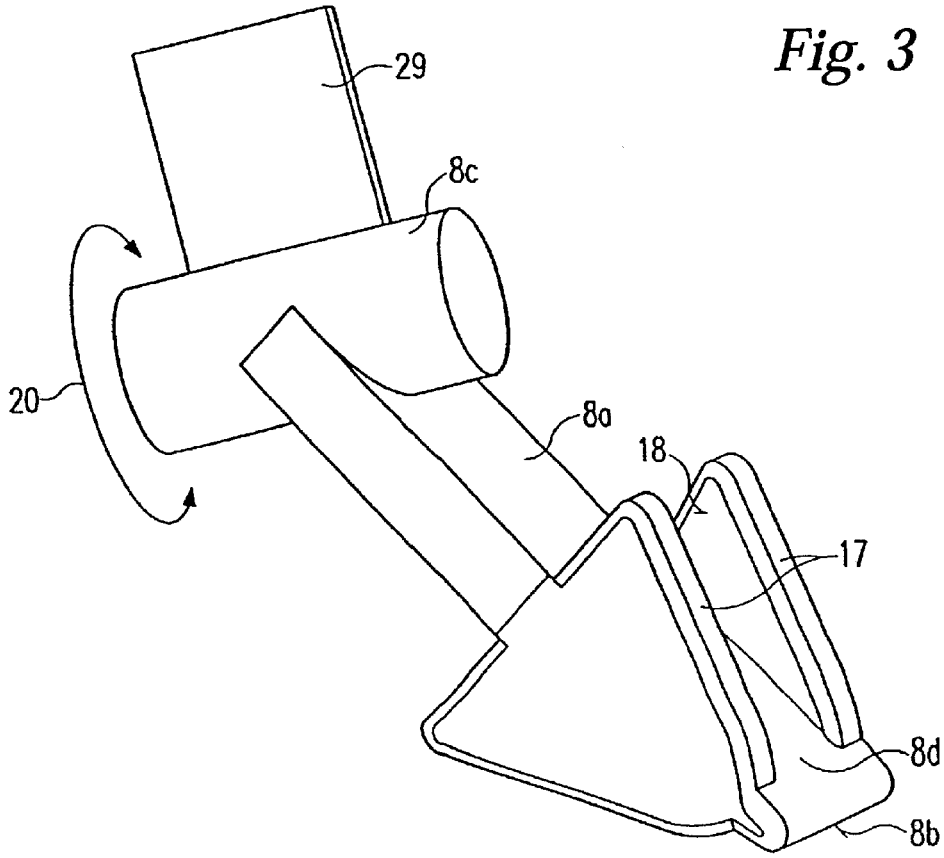
FIG. 4 is a side perspective view of a modified version of an application member.

The embodiment exemplified in FIG. 4, in which the same or similar parts are given the same reference numbers, has two features which distinguish it from the exemplified embodiment described above. First, spring element 29 projects from bearing section 8*c* radially rather than axially, two stop webs 31 being arranged offset on housing parts 5*a*, 5*b* accordingly and laterally bordering the end portion of the spring which is formed as an axially and radially extending leaf spring element 29 in this embodiment as well. Second, application end 8*a* does not extend from the front end of bearing section 8*c* but rather from the central longitudinal section thereof so that free front ends of bearing section 8*c* project on both sides of application end 8*a*, which front ends face can serve to perform the swivel bearing of bearing section 8*c*.

For simplification reasons, axially effective limiting elements for swivel bearing 16 are not illustrated in this embodiment. These elements can also be formed by a radial engagement in a swivel groove or bearing recess or by the fact that bearing parts protrude beyond the front ends of bearing section 8*c* and therefore axially limit them.

Figure 5:
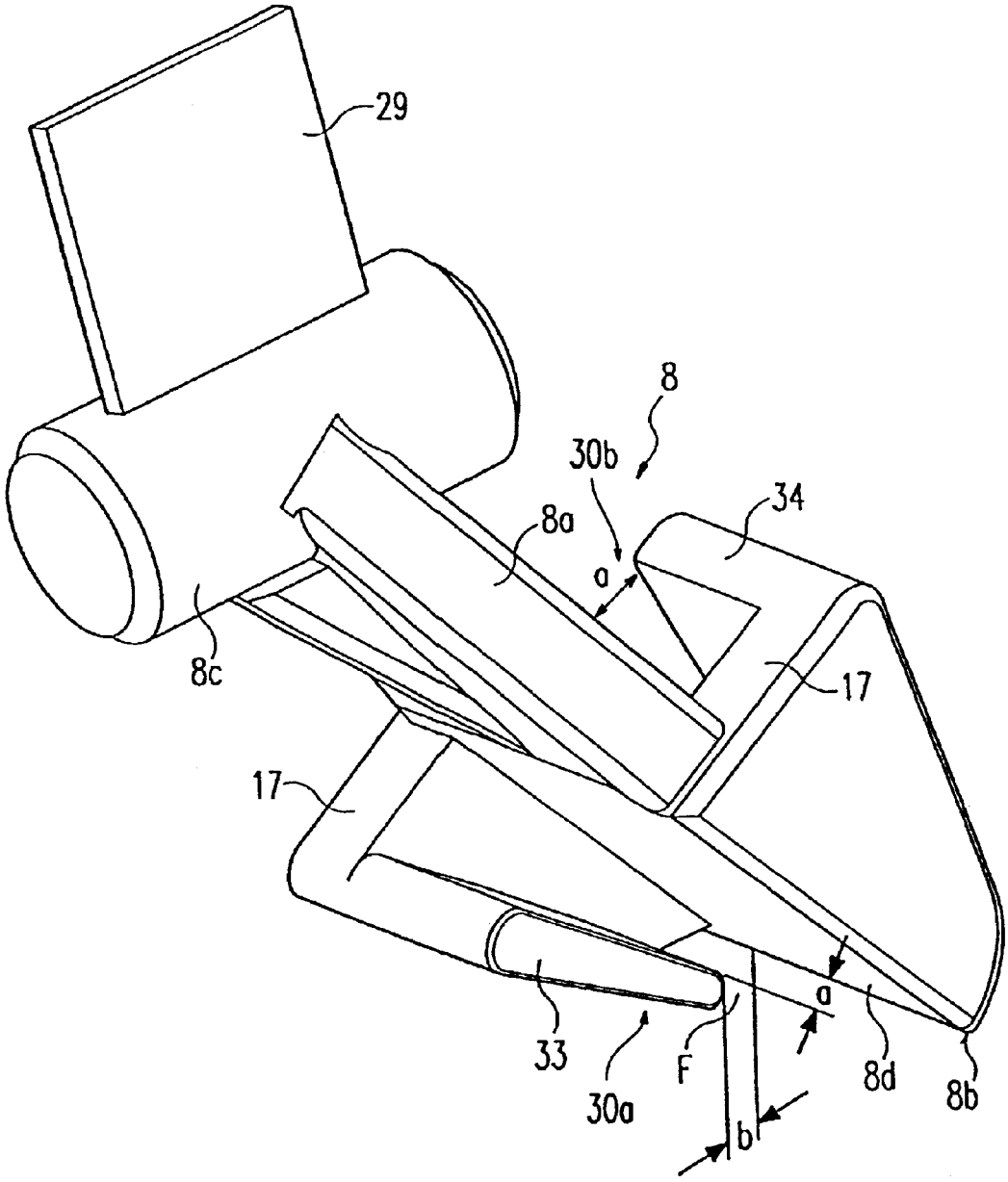
FIG. 5 is a back perspective view of a further modified version of an application member.

In the exemplified embodiment of application member 8 according to FIG. 5, in which the same or similar parts are given the same reference numbers, guiding webs 17 are provided on just one side of each broad side of spatula 8*d*, namely on alternate sides such that guiding webs 17 produce a Z-shape with spatula 8*d*. This design makes it possible to save on two guiding webs 17. The guidance of backing tape 3 and/or film 2 is nonetheless guaranteed because both tape sections 3*a*, 3*b* are allocated one guiding web 17 each on the outside.

In the embodiment exemplified by FIG. 5, a further modification of application member 8 is realized by application end 8*a* having a protective wall 33, 34 on tape approach side 30*a* and/or tape return side 30*b*, which wall is at a distance a from application end 8*a* so that the affiliated tape sections can each extend between protective wall 33, 34 and application end 8*a*. The purpose of the minimum of one protective wall 33, 34 is to protect backing tape 3 and/or film 2 from being damaged.

As can be seen from FIG. 5 in particular, protective wall 33 arranged on application side or tape approach side 30*a* of application member 8 is at a distance b from ridge 8*b* extending in the longitudinal direction of application end 8*a*. This guarantees that, in the operating mode, ridge 8*b* can be pressed onto substrate 4 with the required pressure, wherein protective wall 33 is to lie in the space F produced. In contrast to this, only a gap is needed between the other upper protective wall 34 (in the use position) and ridge 8*b* to guide the tape through. If, omitting the distance a, protective wall 34 extends as far as ridge 8*b* or even somewhat beyond it, then this creates a prevention measure which prevents application member 8 being used in an upside-down position, an act which would entail backing tape 3 being transported in the wrong transporting direction, device 1 not working and a defect being produced.

Application apparatus 6 according to the present invention is also characterized by a design which is simple and inexpensive to produce and also easy to assemble. The individual parts of device 1 are preferably made of plastic, particularly plastic produced by an injection molding process. Housing parts 5*a*, 5*b* and application member 8 can each be manufactured as one piece.

Figure 6:
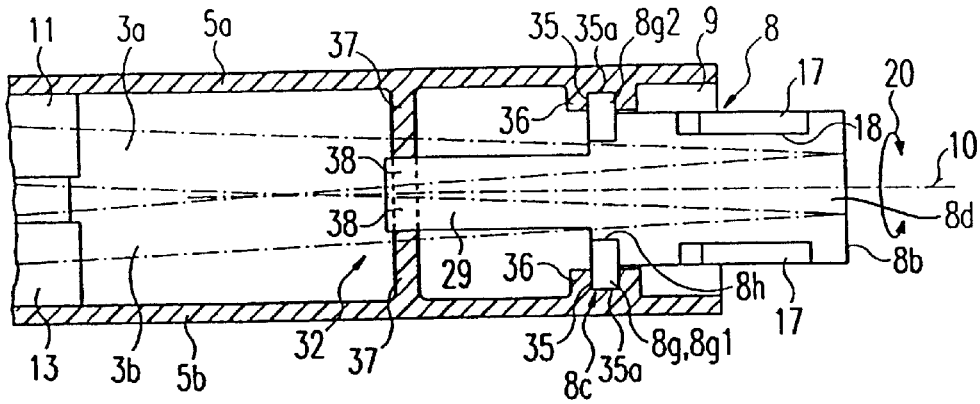
FIG. 6 is a cross-sectional bottom view of the front end portion of a modified device along a cross-sectional line as in I—I in FIG. 2.
Figure 7:
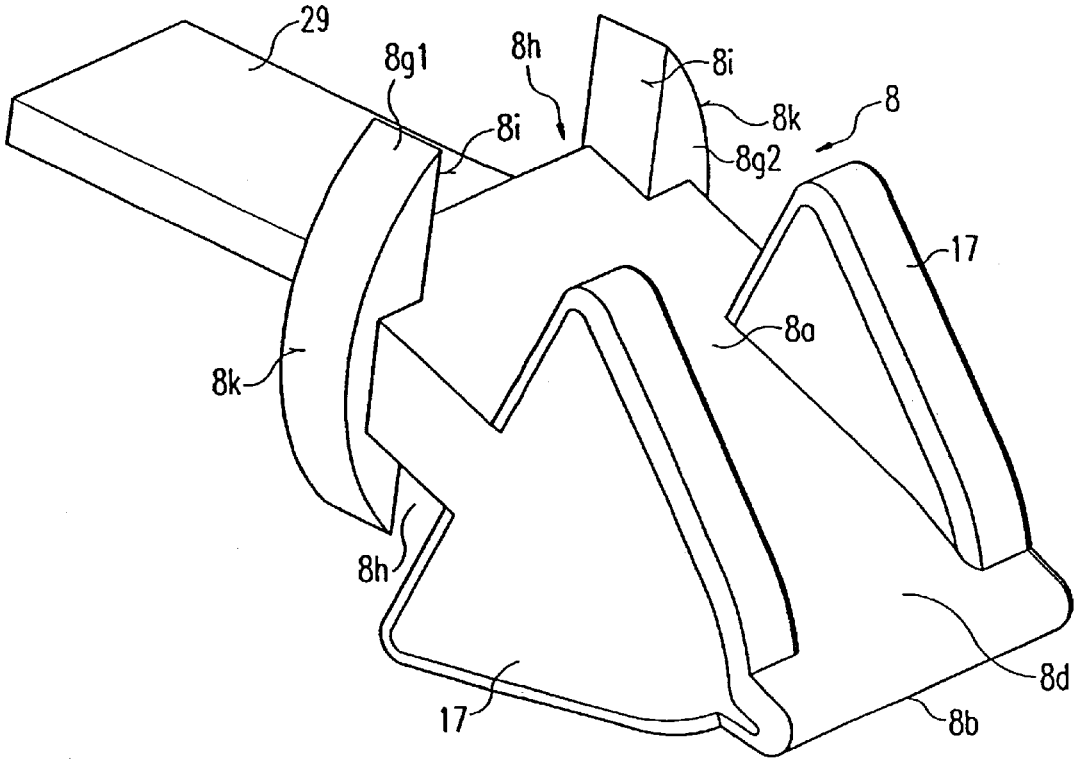
FIG. 7 is a perspective view of the application member according to FIG. 6.
Figure 8:
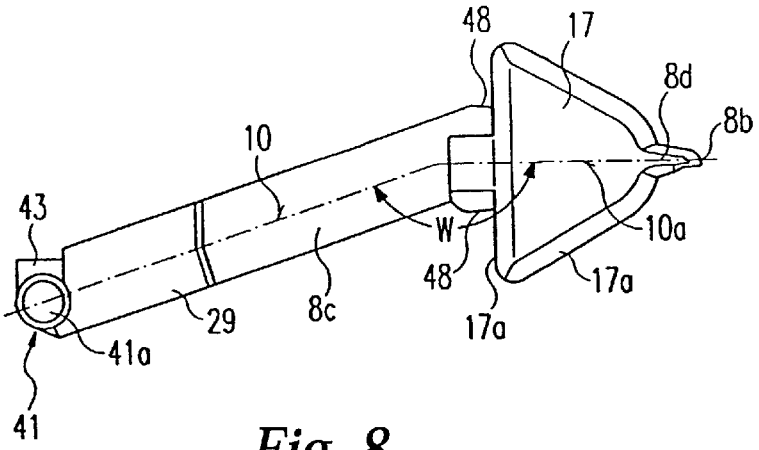
FIG. 8 is a side elevational view of a further modified embodiment of an application member.

In the exemplary embodiment according to FIGS. 6 and 7, in which the same or similar parts are given the same reference numbers, bearing section 8*c* of application member 8 is much shorter and is formed by a round bearing flange 8*g* which is rotatably or swivellably mounted about rotational axis 10 in a corresponding groove 35 in cross-walls or parts 36 (referenced herein as a cross-wall for the sake of convenience without any intent to limit) of housing parts 5*a*, 5*b*. Since a swivelling movement is sufficient for ensuring that application member 8 functions satisfactorily, flange 8*g* and groove 35 do not have to be ring-shaped elements. Rather, it is adequate for these elements to be formed by two segments arranged laterally opposite each other. In this exemplary embodiment, two such flange segments 8*g*1, 8*g*2 are provided with preferably rectangular recesses 8*h* existing between them above and beneath application end 8*a* or spatula 8*d*. Recesses 8*h* not only lead to a saving on material and weight but can also form free spaces for the tape sections 3*a*, 3*b*. Furthermore, side surfaces 8*i* of flange segments 8*g*1, 8*g*2 facing each other can form guiding surfaces for tape sections 3*a*, 3*b*.

In this embodiment (See FIGS. 6 and 7), spring element 29 can be directly connected to spatula 8*d* or the spatula shaft protruding rearwards beyond guiding webs 17, flange 8*g* or flange segments 8*g*1, 8*g*2 being arranged in the transition section between the spatula shaft and spring element 29.

Cross-walls (denoted by reference numbers 36 and 37) projecting inwards from side walls 5*a*, 5*b* or preferably formed thereon can also serve to bear application member 8. In this embodiment, spring element 29 forming a flat spring extends level or parallel to ridge 8*b* of application member 8, flat spring element 29 engaging into grooves 38 of the affixed cross-walls 37. It is also possible for just one cross-wall 37 and one groove 38 to be provided.

In this embodiment, spring element 29 can be longer, thus increasing the elasticity in respect of a reverse bending of application member 8 after pivotable movement without a change in the length of the device being necessary.

The axial positioning is guaranteed by the side walls of the groove positively preventing application member 8 from being axially displaced. Shell surface 8*k* of flange 8*g* or the shell surface sections of flange segments 8*g*1, 8*g*2 forming a radially effective bearing surface having a preferably cylindrical or cylindrical section shape. Base surface 35*a* of groove 35 is also formed accordingly. The axial width of flange 8*g* or flange segments 8*g*1, 8*g*2 can be just a few millimeters wide, for example roughly 1 to 4 mm, especially approximately 2 mm. Cross-wall 36 can be concavely curved on the inner side in line with the curving of flange segments 8*g*1, 8*g*2. The spatula shaft can conform to the width of spatula 8*d* with flange 8*g* or flange segments 8*g*1, 8*g*2 projecting radially therefrom. Spring element 29 can be laterally tapered relative to the spatula shaft.

This embodiment is characterized by a small construction which can be advantageously integrated in housing 5, thereby enabling the application member to be optimally borne by a spring arrangement and also leads to a large bearing surface.

The embodiment exemplified in FIGS. 8 to 11, in which the same or similar parts are given the same reference numbers, has several features which distinguish it from the exemplified embodiments described in the foregoing. For one, a support element 41 dimensioned to be broader than spring element 29 is provided at the free or rear end of spring element 29 preferably forming a flat spring, said support element 41 having a shape different from a rotational-symmetrical shape relative to the swivelling axis 10 of bearing section 8*c*. In the exemplified embodiment, support element 41 has the shape of a cylindrical positioning pin 41*a* extending parallel to ridge 8*b*, which extends to both sides in relation to longitudinal central plane 42 running at right angles to ridge 5*b* and thus projects from spring element 29 towards both sides. At the upper side of cylindrical positioning pin 41*a*, an extension 43 can be provided concentrically, which, in the exemplified embodiment, also has the shape of a cylindrical pin projecting slightly upwards.

At one or both housing parts 5*a*, 5*b*, recesses are formed (not illustrated) at web walls, which form a form-fit engagement with sections of support element 41 which are present at one or at both sides of longitudinal central plane 42. Thereby, application member 8 is positioned in its central position both in an axial direction and in its peripheral direction. After a torsion movement of spatula 8*d* around longitudinal central axis 10, application member 8 is automatically returned to its central position by the elastic restoring force of spring element 29 in the absence of the torsional force.

Another feature of the embodiment of FIGS. 8 to 11 not shown in the previously described embodiments is that at least one lateral projection 44 is formed at bearing section 8*c*, which can project from bearing section 8*c* in the exemplified embodiment in the top view toward the left-hand side. It is the purpose of lateral projection 44 to limit swivelling movements of bearing section 8*c* around its swivelling axis 10. For this purpose, stop portions (not illustrated) projecting into the track of travel of lateral projection 44 are formed at appertaining housing part 5*a* are formed, against which lateral projection 44 is pushed in the swivelling end positions. As can be recognized, especially in FIG. 9, first lateral projection 44 is arranged slightly offset to the bottom in relation to the longitudinal central axis of bearing section 8*c* so as to project secantially from cylindrical bearing section 8*c*. A second projection 45 can be provided, which projects from the circumference of bearing section 8*c* axially offset towards ridge 8*b* in relation to first lateral projection 44, preferably towards the same side as first lateral projection 44. Second lateral projection 45 can serve for the same purpose as lateral projection 44. The limitation of the swivelling movement of spatula 8*c* can be, for example, such that the one projection is pushed against a stop portion at the associated housing part in the one rotational or swivelling direction and the other projection is pushed against an associated stop portion at the appertaining housing part in the other rotational or swivelling direction.

Figure 9:
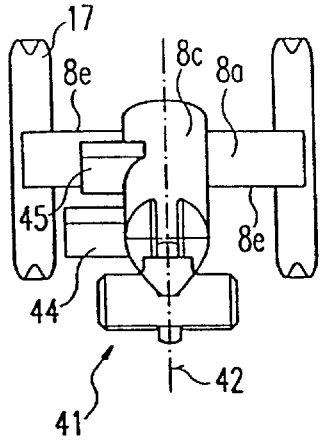
FIG. 9 is a back elevational view of the application member according to FIG. 8.
Figure 10:
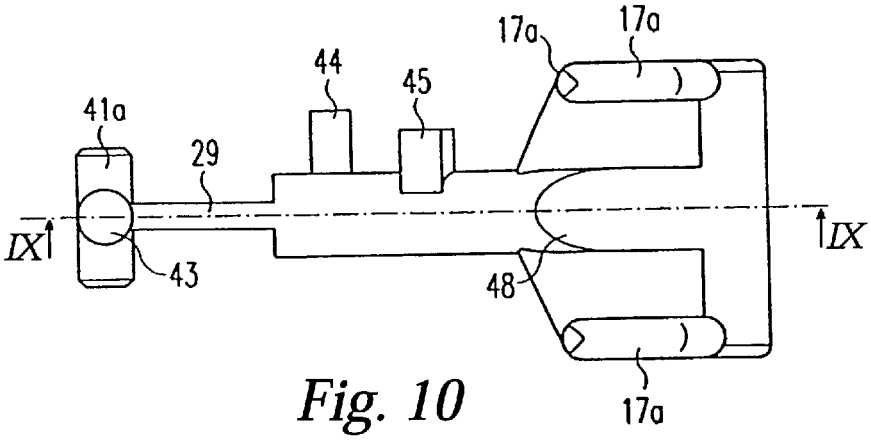
FIG. 10 is a top elevational view of the application member according to FIG. 8.
Figure 11:
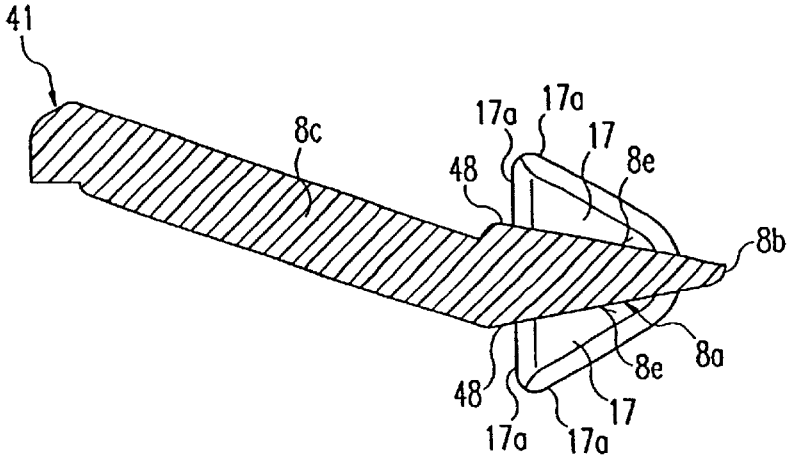
FIG. 11 is a cross-sectional view along Line XI—XI of an application member as in FIG. 10 with certain features not illustrated.

Moreover, rims 17*a* of guiding webs 17 are shaped as half-circles in the exemplified embodiment according to FIGS. 8 to 11, which can best be gathered from FIGS. 9 and 10. This improves the guidance of backing tape 3 or backing tape sections 3*a*, 3*b*, thus avoiding contact with edges of guiding webs 17, which might impair the side edges of backing tape 3 in a backing tape 3 slightly laterally offset. Even if backing tape sections 3*a*, 3*b* were to form a bulging loop in the operation mode, the rounding of rims 17*a* of guiding webs 17 improves the insertion of tape sections 3*a*, 3*b* between guiding webs 17 or guide groove 18.

Figure 12:
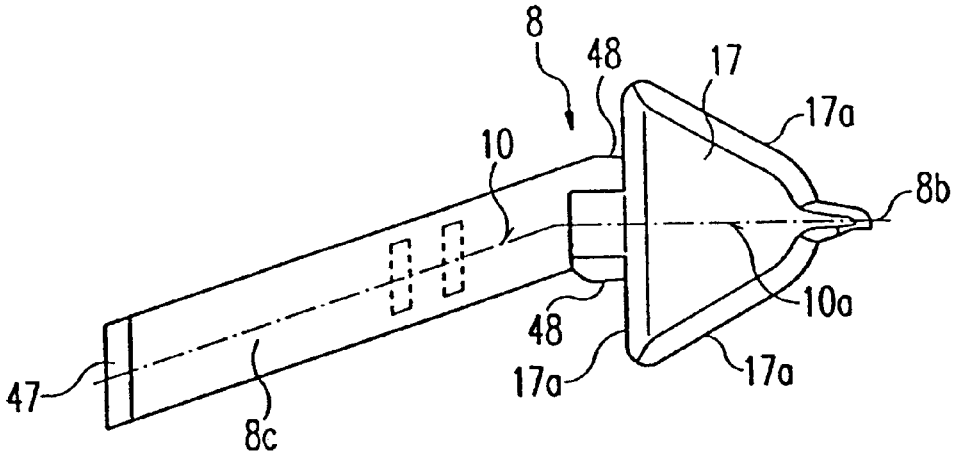
FIG. 12 is a side elevational view of a further modified embodiment of an application member.
Figure 13:
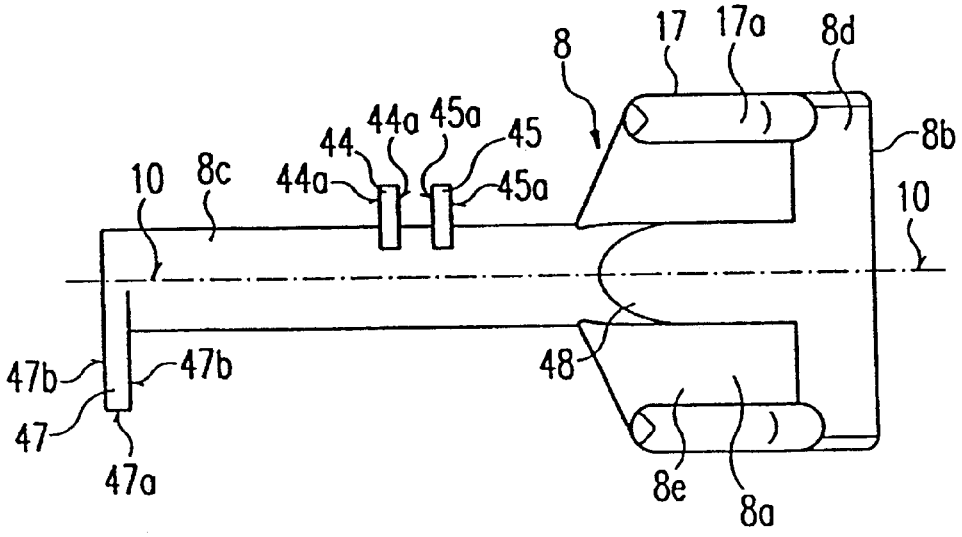
FIG. 13 is a top elevational view of the application member according to FIG. 12.

The embodiment exemplified in FIGS. 12 and 13, in which also the same or similar parts are given the same reference numbers, distinguishes itself from the exemplified embodiment according to FIGS. 8 to 11 primarily in that spring element 29 is missing and that the support element is formed at the rear end of cylindrical bearing section 8*c*. This support element has the shape of a projection 47 projecting towards one side only, which can have the shape of a strip extending transversely whose free end is limited by a plane frontal area 47*a* forming a rectangular end of the strip. In this exemplified embodiment, projection 47 is positioned on the side of bearing section 8*c* which is opposite lateral projections 44, 45. Lateral projections 44, 45 are in axial positions one after the other.

As is illustrated especially by FIG. 13, axial boundary surfaces 44*a*, 45*a*, and 47*b* of lateral projections 44, 45, and projection 47, respectively, can be at right angles to central axis 10*a* of application end 8*a*. This can be advantageous for technical reasons of shape.

As already in the exemplified embodiment according to FIGS. 8 to 11, application end 8*a* is reinforced also in the exemplified embodiment according to FIGS. 12 and 13 by a central web 48 which projects from the upper and/or lower wedge surface rearwards in a divergent fashion like a slant ramp.

In the exemplified embodiments according to FIGS. 8 to 13, application member 8 is a die-cast part and is preferably made of plastic material.

What is claimed is:

1. An application member for a device for transferring a film from a backing tape onto a substrate, the device having a housing in which a film supply is arranged, and said application member extending from an opening in the housing, said application member comprising:

a bearing section pivotably mounted about a swiveling axis in the housing; and an application end extending from said bearing section and having a film approach side and a tape return side; and a protective wall arranged on at least one of said film approach side and said tape return side of said application end at a distance from said application end, the backing tape extending between said application end and said protective wall.

2. An application member according to claim 1, wherein said application end is formed by a spatula.

3. An application member according to claim 2, wherein a guiding web is provided on said tape approach side and said tape return side of said spatula.

4. An application member according to claim 2, wherein said spatula has broader dimensions than an associated cross-sectional measurement of said bearing section.

5. An application member according to claim 3, wherein a single guiding web is arranged on each outer side of said spatula.

6. An application member according to claim 1, wherein said bearing section is pivotably mounted about a swiveling axis extending transversely to a plane of the opening in the housing.

7. An application member according to claim 6, further comprising a spring element on one of said application members and said housing to restrict swiveling movement of said application member.

8. An application member according to claim 1, wherein said bearing section is formed by a flange or laterally opposing flange segments with peripheral surface or peripheral surface sections forming a pivot bearing with mating surfaces on the housing.

9. An application member according to claim 2, wherein said protective wall is arranged on at least one of said film approach side and said tape return side of said spatula at a distance from said spatula, and the backing tape extends between said spatula and said protective wall.

10. An application member according to claim 9, wherein:

said spatula has a ridge around which the backing tape runs; and said protective wall is on said tape approach side of said spatula and projects approximately just as far as said ridge of said spatula.

11. An application member according to claim 10, wherein said protective wall on said tape approach side of said spatula projects approximately just as far as said ridge protrudes.

12. An application member according to claim 1, wherein said protective wall is supported by a guiding web for the backing tape.

13. An application member according to claim 9, wherein said spatula has two guiding webs on said spatula, said spatula and guiding webs being in the form of a Z-shape.

14. An application member according to claim 1, wherein a bearing ring is formed around said bearing section.

15. An application member according to claim 1, wherein said bearing section extends perpendicular to a plane of the opening in the housing.

16. An application member according to claim 1, further comprising guide wings arranged on at least one side of said application end.

17. An application member according to claim 16, wherein said guide wings have rims in the shape of half-circles.

18. An application member according to claim 1, further comprising a spring element projecting from said application member, wherein said spring element is confined in a pivot center position of said application member and positioned to engage at least one stop on the housing.

19. An application member for a device for transferring a film from a backing tape onto a substrate, the device having a housing in which a film supply is arranged, and said application member extending from an opening in the housing, said application member comprising:

a bearing section pivotably mounted about a swiveling axis in the housing; and an application end extending from said bearing section;

wherein:

said application end and said bearing section enclose an obtuse angle therebetween, said angle being open towards a film approach side of said application member; and a leaf spring element integral with one of said application member and the housing engages at least one stop on the other of said application member and the housing to restrict swiveling movement of said application member, whereby said application member is centered by an elastic force from both sides of the at least one stop.

20. An application member according to claim 19, wherein said obtuse angle is between approximately 20° and 170°.

21. An application member according to claim 20, wherein said obtuse angle is approximately 150°.

22. An application member according to claim 19, wherein said leaf spring element projects axially from said application member.

23. An application member according to claim 19, wherein said leaf spring element projects radially from said application member.

24. An application member according to claim 19, wherein said leaf spring element projects from said application member, and is confined in a pivot center position of said application member between the at least one stop on the housing.

25. An application member according to claim 19, wherein said at least one stop is positioned laterally of said leaf spring element to restrict swiveling movement of said application member.

* * * * *